United States Patent [19]

Alberelli et al.

[11] 3,987,978

[45] Oct. 26, 1976

[54] SPOOL MAGAZINE

[75] Inventors: Alberino Alberelli; Ida Alberelli, both of New Hyde Park, N.Y.

[73] Assignee: Lawrence Peska Associates, Inc., New York, N.Y. ; a part interest

[22] Filed: Jan. 14, 1976

[21] Appl. No.: 649,196

[52] U.S. Cl. ..... 242/134

[51] Int. Cl.[2] ..... B65H 49/18

[58] Field of Search..... 242/129.5, 134, 136, 242/141; 223/106; 112/1, 231, 257

[56] References Cited

UNITED STATES PATENTS

| | | | |
|---|---|---|---|
| 988,837 | 4/1911 | Tharp | 242/136 |
| 1,387,368 | 8/1921 | Douglass | 242/134 |
| 2,858,089 | 10/1958 | Yasui | 242/134 |

*Primary Examiner*—Leonard D. Christian
*Attorney, Agent, or Firm*—Jack D. Slobod

[57] ABSTRACT

A spool magazine for a sewing machine includes a first member having a tubular portion and an elongated rod projecting axially from opposite sides of a spool support disc. The first member is vertically received in extension of the upstanding spool support post of a sewing machine via the tubular portion and a plurality of centrally apertured spool support discs are received on the rod. Each of the latter discs has downwardly projecting legs to enable the discs to be stacked in vertically spaced apart relationship on top of the disc of the first member. The various discs serve as support shelves for spools of thread which are received about the elongated rod.

2 Claims, 4 Drawing Figures

SPOOL MAGAZINE

FIELD OF THE INVENTION

The present invention relates generally to magazines for carrying a plurality of spools of thread on the upstanding thread support post of a sewing machine. In its particular aspects the present invention relates to a magazine for carrying spools of thread in vertically spaced apart relationship.

BACKGROUND OF THE INVENTION

Frequently in the use of a sewing machine, sewing is done sequentially with threads of different colors or strengths. While various magazines have heretofore been proposed for carrying a plurality of spools of thread in side by side relationship on a sewing machine, such devices have taken up a great deal of space along the top of the machine. Illustrative is U.S. Pat. No. 2,990,685 to Glass.

While it may be possible to stack more than one spool of thread directly on the upstanding spool support post of a sewing machine, such posts are generally not long enough to carry as many spools as may be desired for particular applications.

OBJECTS OF THE INVENTION

It is an object of the present invention to provide a magazine for rotatably carrying a plurality of spools of thread in vertically spaced apart relationship on top of a sewing machine.

It is a further object of the present invention to provide a spool magazine constructed of a plurality of sections for enabling spools to be loaded therein in vertically spaced apart relationship.

SUMMARY OF THE INVENTION

Briefly, the aforementioned and other objects of the present invention are satisfied by providing a spool magazine including a first member having a spool support disc adapted to be oriented horizontally. A tubular portion projects axially downward from a bottom surface of the disc for fitting over the usual upstanding spool support post of a sewing machine and an elongated shaft projects axially upward from the disc in extension of the spool support post.

A plurality of second members are provided including centrally apertured spool support discs for reception over the elongated shaft. Each of the latter discs has a plurality of downwardly projecting legs for enabling the second members to be vertically stacked with a bottom one of the second members resting on the spool support disc of the first member.

The spool support discs of the first and second members carry upwardly and outwardly projecting tabs which are provided with thread guiding apertures.

Spools of thread are serially placed on the spool support disc and about the elongated rod as the magazine is built up from the various members enabling a large number of spools to be vertically stacked and independently supported.

Other objects, features and advantages of the present invention will become apparent upon perusal of the following detailed description of the preferred embodiment thereof when taken in conjunction with the appended drawing wherein.

DETAILED DESCRIPTION

Figure 1:
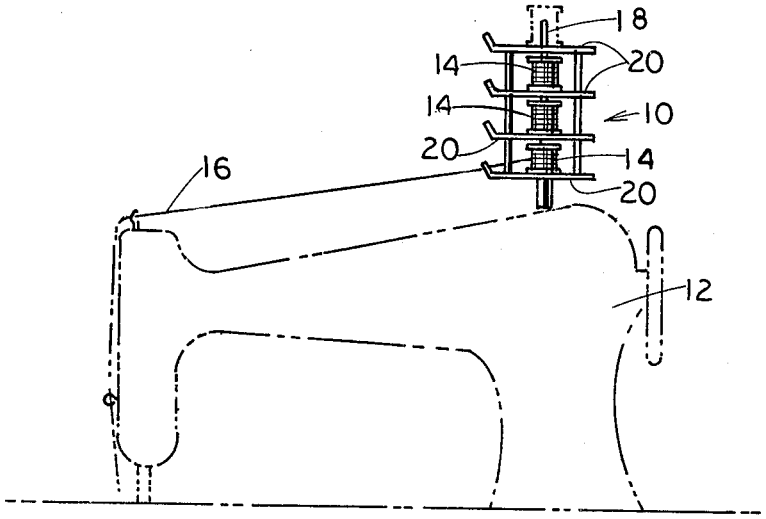
FIG. 1 is an elevational view of the spool magazine of the present invention as positioned on a sewing machine.

Referring first to FIG. 1 of the drawing, the spool magazine of the present invention is generally indicated by the reference numeral 10. Magazine 10 is adapted to be located on top of a sewing machine 12 and holds a plurality of spools 14 of thread in vertically spaced apart relationship thereon. A thread 16 from any selected one of spools 14 is fed to the needle of sewing machine 12. In general, an elongated rod or shaft 18 is provided projecting vertically upwards from sewing machine 12 and a plurality of discs or shelves 20 are vertically spaced therealong. Each spool 14 is received about rod 18 and rests on a different one of discs 20 for independent rotary support of the spools.

Figure 2:
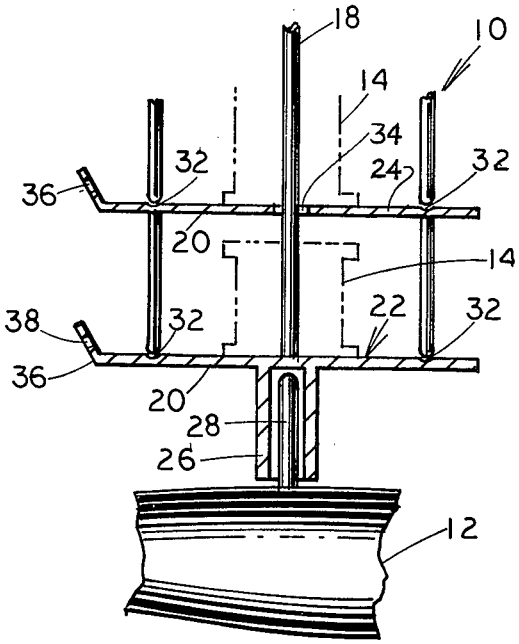
FIG. 2 is an enlarged fragmentary partially cross-sectional view of a lower portion of the spool magazine of FIG. 1.
Figure 3:
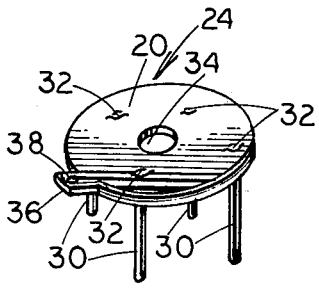
FIG. 3 is a pictorial presentation of one part making up the spool magazine in FIGS. 1 and 2.
Figure 4:
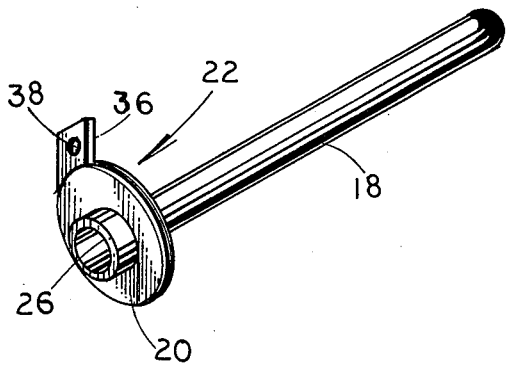
FIG. 4 is a pictorial presentation of another part for the spool magazine.

The magazine 10 is shown in detail in FIG. 2 and it should be apparent therefrom that it is formed from a first member 22, illustrated in FIG. 4, and a plurality of second members 24, illustrated in FIG. 3. Member 22 comprises a disc 20 having a tubular portion 26 integrally projecting axially downward from a bottom surface thereof and dimensioned for reception over the usual upstanding spool support post 28 of sewing machine 12. The elongated rod 18 extends axially upward integrally from the top side of the disc 20 of member 22 to, in effect, vertically extend post 28. Rod 18 is of approximately the same diameter as post 28.

Second members 24 comprises a disc 20 having a plurality of legs 30 extending downward integrally from a bottom surface thereof. Preferably, indentations or dimples 32 are formed in the top surface of disc 20 of members 22 and 24 for receiving the free ends of legs 30 of another member 24 stacked thereon. Further, each of the discs 20 of members 24 have a central aperture 34 dimensioned for receiving rod 18. As should now be understood, the magazine is assembled for use by first placing tubular portion 26 of member 22 on post 28. Next, a spool 14 is slipped over rod 18 and onto the top surface of the disc 20 of member 22. Then one of the members 24 is slipped over rod 18 and positioned with its legs resting on the disc 20 of member 22. Thereafter a spool 14 is slipped over rod 18 and positioned on top of disc 20 of number 24. The magazine 10 is then further built up by alternating members 24 and spools 14.

As an additional feature, the spool support discs 20 of members 22 and 24 are provided with a tab 36 projecting integrally radially outward and upward from the disc periphery. Each tab 36 has an aperture 38 therein for guiding the thread 16 of the spool 14 proximate thereto.

While the preferred embodiment of the present invention has been described and illustrated in specific detail, it should be understood that numerous modifications, additions and omissions in the details thereof are possible within the intended spirit and scope of the invention claimed herein.

What is claimed is:

1. A magazine for supporting a plurality of spools of thread in vertically stacked relationship on top of an upstanding spool support post of a sewing machine comprising:

a first member having a spool support shelf adapted to be oriented horizontally;

a tubular portion projecting downward from a bottom side of said shelf for reception about said spool support post, and an elongated shaft projecting upward from a top side of said shelf for sequential passage through said spools;

a plurality of second members each having a shelf adapted to be oriented horizontally, central apertures in said shelves of said second members dimensioned for receiving said shaft of said first member, and a plurality of legs projecting downward from a bottom side of said shelf of said second member;

whereby said plurality of second members can be stacked one upon the other with a bottom one of said second members resting on the shelf of said first member.

2. The device of claim 1, wherein the shelves of said first and second members each have a tab projecting upward and outward integrally from the peripheries of said shelves; and thread guiding apertures in said tabs.

* * * * *